US007677167B2

(12) United States Patent
Santoro

(10) Patent No.: US 7,677,167 B2
(45) Date of Patent: Mar. 16, 2010

(54) PAPER RECYCLING DEVICE

(76) Inventor: Gerald J. Santoro, 33 Woodcrest La., Goshen, NY (US) 10924

( * ) Notice: Subject to any disclaimer, the term of this patent is extended or adjusted under 35 U.S.C. 154(b) by 0 days.

(21) Appl. No.: 12/079,729

(22) Filed: Mar. 28, 2008

(65) Prior Publication Data

US 2008/0236410 A1 Oct. 2, 2008

Related U.S. Application Data

(60) Provisional application No. 60/921,140, filed on Mar. 30, 2007.

(51) Int. Cl.
*B65B 13/02* (2006.01)
*B65B 13/18* (2006.01)

(52) U.S. Cl. ..... 100/2; 100/34; 53/399; 53/592; 206/442

(58) Field of Classification Search ..... 100/2, 100/34; 53/390, 592, 399; 206/555, 442; 414/788, 788.1
See application file for complete search history.

(56) References Cited

U.S. PATENT DOCUMENTS 330,130 A 11/1885 Kinney
4,941,653 A 7/1990 Sterner, Jr.
4,993,318 A 2/1991 Bollinger
5,004,099 A * 4/1991 Carpenter et al. ..... 206/83.5
5,072,576 A 12/1991 Evans
5,129,526 A 7/1992 Craft, Jr. et al.
5,328,088 A 7/1994 Lonczak
5,533,318 A 7/1996 Murat
5,577,440 A 11/1996 Marie
5,586,493 A 12/1996 McEntee
5,690,024 A * 11/1997 Jarund ..... 100/34
6,374,728 B1 4/2002 Baillie
6,945,424 B1 * 9/2005 Gardner ..... 220/600

* cited by examiner

*Primary Examiner*—Jimmy T Nguyen
(74) *Attorney, Agent, or Firm*—Dara L. Onofrio, Esq.; Onofrio Law

(57) ABSTRACT

A device and related method for storing and bundling papers, magazines and/or cardboard, for easy disposal and recycling comprised of a storage unit comprising four side walls and a bottom surface wherein a top area is open and permits stacking of papers on said bottom service; and a single source of twine in a pre-arranged pattern within said storage unit for easy bundling of the papers, magazines and/or cardboard.

7 Claims, 4 Drawing Sheets

PAPER RECYCLING DEVICE

This application claims the benefit of U.S. provisional application No. 60/921,140 filed Mar. 30, 2007, which is incorporated herein in its entirety by reference.

FIELD OF THE INVENTION

In general the present invention relates to a device for storing and bundling papers for easy disposal. More specifically, the invention relates to a recycling bin lined with twine in a prearranged pattern for easy bundling of newspapers, magazines and other papers and cardboard to be disposed of and recycled.

BACKGROUND OF THE INVENTION

The general disclosure of devices for bundling newspapers and the like are illustrated in the representative patents are listed below.

U.S. Pat. No. 6,374,728 to Baillie discloses a device for bundling recycled newspapers having a twine dispenser. The newspapers are stacked in a vertical position on top of a pair of shelves and are tied in perpendicular directions. The device has two sides a bottom and back wall. The front and top of the unit is open for placement of the newspapers or other materials.

U.S. Pat. No. 5,586,493 to McEntee discloses a paper recycling rack having a series of slots through which bundling twine can be passed. The bundled papers are stored at the bottom portion of the rack.

U.S. Pat. No. 5,533,318 to Murat discloses a newspaper storage and bundling system. Newspapers and the like are collected inside the storage space until they reach the top when the rope ends are unwrapped from reels and brought together around the newspaper pile and tied in a knot. A handle is centered over the knot and is used to remove the paper bundle. The rope mechanism is at the bottom of the storage space in which a circle means directs the twine in four directions all at 90 degree angles from each other.

U.S. Pat. No. 5,129,526 to Craft Jr. et al. discloses a container for stacking and bundling newspaper. Rather than tying the bundles with twine this container provides for bundling within a bag.

U.S. Pat. No. 5,072,576 to Evans discloses a newspaper bundler having front, back and side walls and a bottom section. Each side wall has a twine dispenser below the container bottom wall sections. The twine is pulled up around four sides of the bundle and tied and secured around the newspaper stack. U.S. Design Pat. 330,130 illustrates the related design for this newspaper bundling rack.

U.S. Pat. No. 4,941,653 to Sterner, Jr. discloses a combination trash and newspaper receptacle. A binding twine receptacle is used to bundle the newspapers.

www.homefocuscatalog.com illustrates a product entitled the Wrought Iron Recycle Bin. The bin holds newspapers in a stack and when its full twine is slide under the bottom for easy tying.

The present invention provides an advantage over known devices in presenting a simple light weight recycling center used to bundle, tie and store newspapers in a neat and organized manner using a single source of twine. The invention is easy to use and provides consumers with a convenient means to help the environment. The bin is used to gather and stack the paper and twine is used to tie the newspapers into bundles until recycling day.

The invention makes it easy to bundle papers for recycling. It eliminates clutter on tables and floors, which save a person considerable amount of time and effort. The invention recycling system permits newspapers, magazines, cardboard and the like to be neatly stored and bundled allowing a person to easily transport the bundles outside.

Another advantage over the prior art is that the invention is space-saving and durable for years of effective use and could be produced in a variety of colors and styles to match any decor.

Yet a further object of the invention is in encouraging recycling activities because of its convenient and compact design. Individuals who previously were unwilling or unable to recycle paper will use the item to quickly and easily bundle and tie paper. These individuals are encouraged to recycle paper that would otherwise be discarded and may subject them to penalty.

Another object of the invention is in providing a neat storage area between recycling days. The accumulated paper is easily bound and removed as a tightly secured package. The invention solves the problem of storing and tying loosely accumulated paper waste.

A further object of the invention is in providing convenience, durability, ease of use, practicality, compact size, light weight, space-savings, time savings, reusability and effectiveness. This recycling device saves consumers time and energy when preparing their newspapers or waste papers, since a durable base and strong storage box is provided to neatly gather and tie the pile, as well as store the bundles.

Another object of the invention device is in offering users a convenient way to handle the accumulation of paper. Consumers can quickly and easily gather, tie and store newspapers to benefit the environment.

An object of the invention device provides paper piles that are easier to carry outside and would help to prevent any back strain by the user.

Another object of the device is neatness and reduction of clutter and loose papers, as well as saving space in a kitchen, garage or mudroom area.

The invention system allows a user to conveniently store, bind and remove paper for collection. Increasing the amount of paper being recycled by the consumer or end-user reduces cost for waste handlers at the landfill site.

In addition to home or personal use, the recycling unit can be used in commercial establishments and businesses.

SUMMARY OF THE INVENTION

In the present invention, these purposes, as well as others which will be apparent, are achieved generally by a device for storing and bundling papers, magazines and/or cardboard for easy disposal and recycling. The device is comprised of a storage unit having four side walls and a bottom surface wherein a top area is open and permits stacking of papers. A single source of twine in a pre-arranged pattern within said storage unit is included for easy bundling of the papers.

The device also includes a cutting blade. The cutting blade is preferably on the top lip of a side wall containing the twine.

A spool of twine is provided on the outer surface of one of the side walls.

The side wall opposite the side wall containing the twine has a slot on the top lip such that the twine can be placed in said slot without slipping.

In general, at various points throughout the device a means for holding the twine in place is contained on at least one side wall, and most preferably on at least three side walls. The holding means includes hooks, notches, latches, slots, holes or the like serving the same or a similar function.

Optionally, the device also includes a handle on at least one side wall.

Preferably the storage space is rectangular in shape, but other sizes and shapes are encompassed by the invention depending on the material being recycled. The storage unit is of a size to easily hold letter or legal size papers and magazines, newspapers and other materials capable of being bundled and recycled. The device itself can be conveniently placed next to a copy or fax machine for recycling purposes.

In alternate embodiments, the storage unit is large enough to hold larger cardboard pieces from packages and boxes.

The device is preferably made of a durable, sturdy plastic or synthetic material. However, other materials may be used such as wood or even corrugated cardboard.

The invention also provides a method for bundling papers, magazines and/or cardboard for easy disposal and recycling. A device for storing and bundling waste papers, magazines and/or cardboard for disposal is provided made of a storage space having four side walls and a bottom surface, and a top area which is open and permits stacking of the waste papers.

In general a single source of twine is placed in a pre-arranged pattern within the storage space. More specifically, as shown in FIGS. 1A and 1B, the twine is looped through a hole 1 on the side wall containing the spool of twine; it is then pulled across the bottom surface of the storage space to rest on first notch 2 on the top lip of the side wall opposite the spool of twine. The twine is then wrapped around first hook 3 on the corner edge of the side wall opposite the spool of twine and placed on second notch 4 on side wall next to side wall containing the spool of twine. The twine is further pulled across the bottom surface of the storage space to rest on third notch 5 on the opposite side wall. Essentially, being formed into a cross shape in the center of the storage space. The twine is rested on second hook 6 located on the side wall underneath third notch 5 while waste paper is placed in the center of the storage space. Once the device is full the twine is cut using a blade located on the side wall containing the spool of twine. The twine from first hook 3 is removed as well as the twine from second and third notches 4 and 5 and placed in the center of the storage space. The twine is tied on top of said waste paper bundle; and removed from said storage space for recycling.

Although as described this is the preferred embodiment of pre-arranging the twine within the storage space, other ways of doing so are also included in the invention and depend upon the particular user. In all embodiments however, only a single continuous piece of twine is used to practice the method of the invention.

The device and method of the invention are provided for both right-handed users as well as for left-handed users.

Other objects, features and advantages of the present invention will be apparent when the detailed description of the preferred embodiments of the invention are considered with reference to the drawings, which should be construed in an illustrative and not limiting sense.

DETAILED DESCRIPTION OF THE INVENTION

In accordance with the present invention devices a recycling device lined with a prearranged pattern of twine is provided. Preferably a spool of twine is attached to one side of the device. The user pulls the spool, places it on the bottom side of the storage unit and wraps it around the outside of the unit. The twine is then placed in the bottom short side of the storage unit, over the opposite side and then tied and hooked onto a latch. The storage unit is filled with newspapers, magazines or the like of any material that can be bundled and potentially recycled. When the storage unit is full the twine is tied and cut from the spool.

As used in the specification herein, the term twine is used interchangeably with string or other like material used to bundle and secure the materials to be disposed of, with no distinctions being made.

The elements of the invention device are as follows:

1—hole for twine opening in storage unit
2—first notch
3—first hook
4—second notch
5—third notch
6—first hook
7—side wall
8—bottom surface
10—twine spool
20—cutting blade
30—string
40—storage unit
41—notch
42—rod support
43—plastic rod with spring loaded locking mechanism
44—hook
45—blade
46—hole
47—hook
48—side A-A' lip
49—side B-B' lip
50—storage space The storage unit is preferably rectangular. In preferred embodiments the storage unit measures 12 inches high, 18 inches long and 14 inches wide. Sizes of the storage space vary depending on material being recycled. Devices for recycling magazines are preferably 10 inches wide by 13 inches long. The height is flexible and preferably range from a minimum of 6 inches on up. In other embodiments, cardboard can be recycled whereby the device is made of larger dimensions. Optional spacers can be installed to accommodate different size uses with one unit.

The storage unit can be made from plastic or synthetic materials. Examples of such materials include polystyrene. However, the storage unit can be made of wood, corrugated cardboard or other like materials.

In a preferred embodiment, substantially entire device may be prepared by injection molding. The spool of twine and the cutting blade can be attached after the injection molding process or can even be assembled by the user just prior to use.

The spool of twine is added to the device separately so that when not in use or in delivery the storage units can be stacked up on each other.

The invention is provided in a wide range of colors, shapes, designs and styles.

Figure 1A:
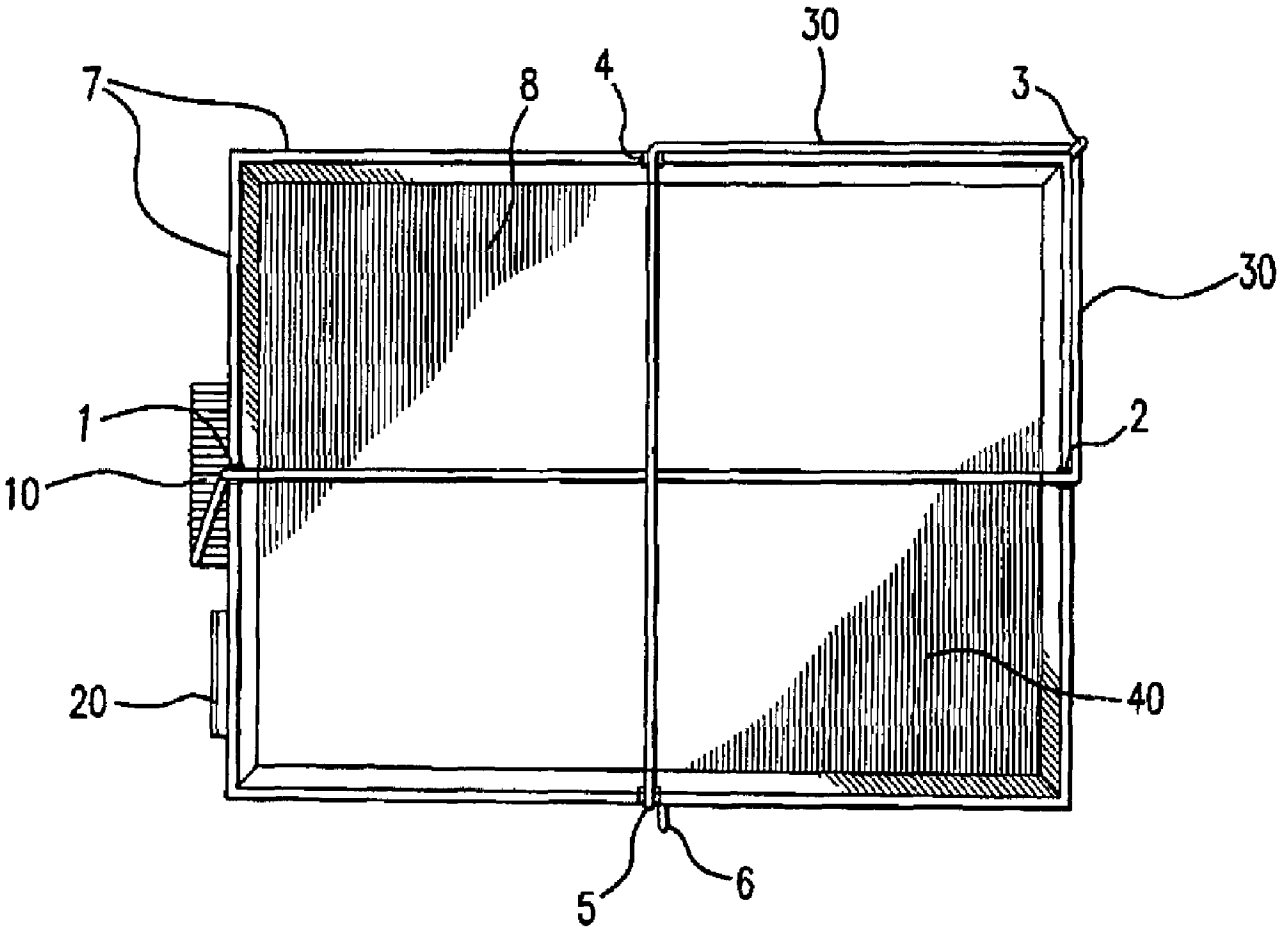
FIG. 1A is an illustration of the top view of the invention device showing the pre-arranged pattern of the twine for right-handed users.
Figure 1B:
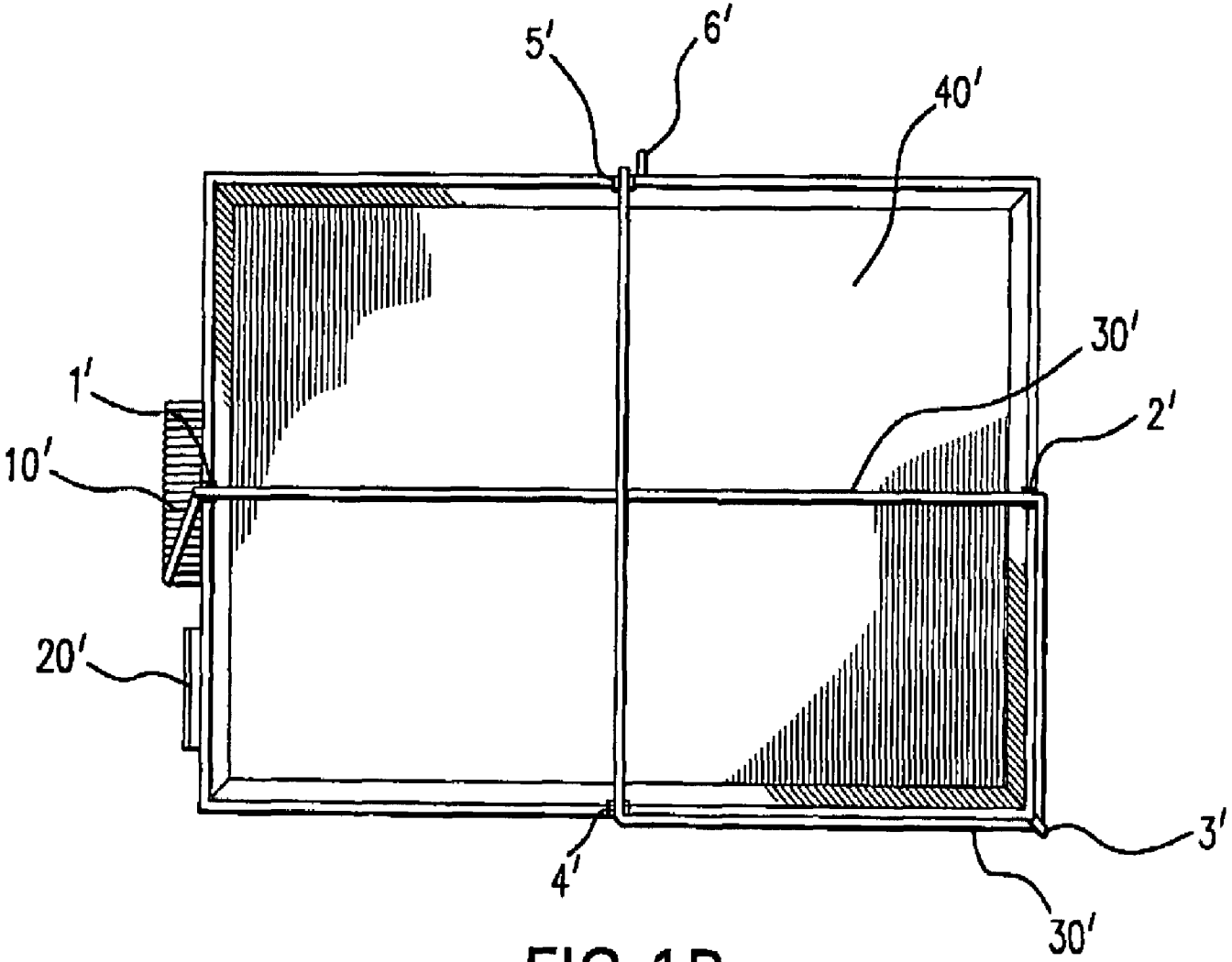
FIG. 1B is an illustration of the top view of the invention device showing the pre-arranged pattern of the twine for left-handed users.

As illustrated in FIGS. 1A and 1B a single source of twine is placed in a pre-arranged pattern within the storage space. More specifically, the twine is looped through a hole 1 on the side wall containing the spool of twine; it is then pulled across the bottom surface of the storage space to rest on first notch 2 on the top lip of the side wall opposite the spool of twine. The twine is then wrapped around first hook 3 on the corner edge of the side wall opposite the spool of twine and placed on second notch 4 on side wall next to side wall containing the spool of twine. The twine is further pulled across the bottom surface of the storage space to rest on third notch 5 on the opposite side wall. Essentially, being formed into a cross shape in the center of the storage space. The twine is rested on second hook 6 located on the side wall underneath third notch 5 while waste paper is placed in the center of the storage space. Once the device is full the twine is cut using a blade located on the side wall containing the spool of twine. The twine from first hook 3 is removed as well as the twine from second and third notches 4 and 5 and placed in the center of the storage space. The twine is tied on top of said waste paper bundle; and removed from said storage space for recycling.

Although as described above, this is the preferred embodiment there are other ways of pre-arranging the twine in the device which are included in the invention and depend on the particular user's preference. In addition, although notches and hooks are described in this embodiment other holding means for holding the twine in the pre-arranged pattern are included in the invention. These means include latches, slots, holes or the like serving the same or a similar function.

To describe such, the invention also includes a method for bundling papers, magazines and/or newspapers for easy disposal and recycling comprising the steps of providing a device for storing and bundling waste papers, magazines and/or newspapers for disposal, wherein the device is comprised of a storage unit having four side walls and a bottom surface, and a top area which is open and permits stacking of the waste papers. A single source of twine in a pre-arranged pattern within said storage unit, wherein said twine is looped through a hole 1 on the side wall containing the spool of twine. The twine is then pulled across the bottom surface of the storage space to rest on a first means for holding or securing the twine on the top lip of the side wall opposite the spool of twine. The twine is then wrapped around a second means for holding or securing the twine on the corner edge of the side wall opposite the spool of twine. It is then placed on a third means for holding or securing the twine on side wall next to side wall containing the spool of twine and pulled across the bottom surface of the storage space to rest on a fourth means for holding or securing the twine on the opposite side wall, wherein the twine is formed into a cross shape in the center of the storage space. The twine is then looped to a fifth means for holding or securing the twine located on the side wall underneath said fourth means. Waste paper is placed in the center of the storage space; and when ready to be bundled the twine is cut using a blade located on the side wall containing the spool of twine. The twine is removed from said second means and bringing twine from said third and fourth means to the center of said storage space and tied on top of said waste paper bundle. When completed the bundle is removed from the storage unit for recycling.

As described in the paragraph above, the means for holding or securing the twine in place is selected from the group consisting of hooks, notches, latches, slots, holes or other like means and combinations thereof.

In particular, FIG. 1A illustrates a top view of the device for a right-handed user. The twine 10 is located on a side wall of the container, with the cutting blade 20 nearby on the same side wall. The cutting blade can be either on the left side of the twine or the right side. The string is looped through a hole in the side wall near the spool and pulled directly across the bottom surface of the storage unit 40 to the side wall opposite the spool of twine to rest on first notch 2.

First notch 2 is located on the top lip of the side wall opposite the spool of twine.

The twine is then wrapped around first hook 3 located on the corner side of the side wall opposite the spool of twine. A hook is preferred but a latch or other means to hold the twine in place may be used.

The twine is pulled and placed on second notch 4 located on the top lip of the side wall adjacent to the spool of twine. The twine is pulled across the storage unit to a third notch 5 on the opposite side wall and placed on a second hook 6 underneath until the storage space is full.

FIG. 1B illustrates a modified embodiment for use by left-handed users. More specifically, the twine is looped through a hole 1' on the side wall containing the spool of twine; it is then pulled across the bottom surface of the storage space to rest on first notch 2' on the top lip of the side wall opposite the spool of twine. The twine is then wrapped around first hook 3' on the corner edge of the side wall opposite the spool of twine and placed on second notch 4' on side wall next to side wall containing the spool of twine. The twine is further pulled across the bottom surface of the storage space to rest on third notch 5' on the opposite side wall. Essentially, being formed into a cross shape in the center of the storage space. The twine is rested on second hook 6' located on the side wall underneath third notch 5' while waste paper is placed in the center of the storage space. Once the device is full the twine is cut using a blade located on the side wall containing the spool of twine. The twine from first hook 3' is removed as well as the twine from second and third notches 4' and 5' and placed in the center of the storage space. The cut twine end looped through hole 1' is tied on top of said waste paper bundle with the end from the second hook 6': and removed from said storage space for recycling.

Once the device is filled with waste papers the twine is cut and brought forward from 2, 3, 4, 5, 6 to the center of the storage unit. The bundle is tied and removed for recycling. The string is then pre-arranged for the next bundle.

Figure 2:
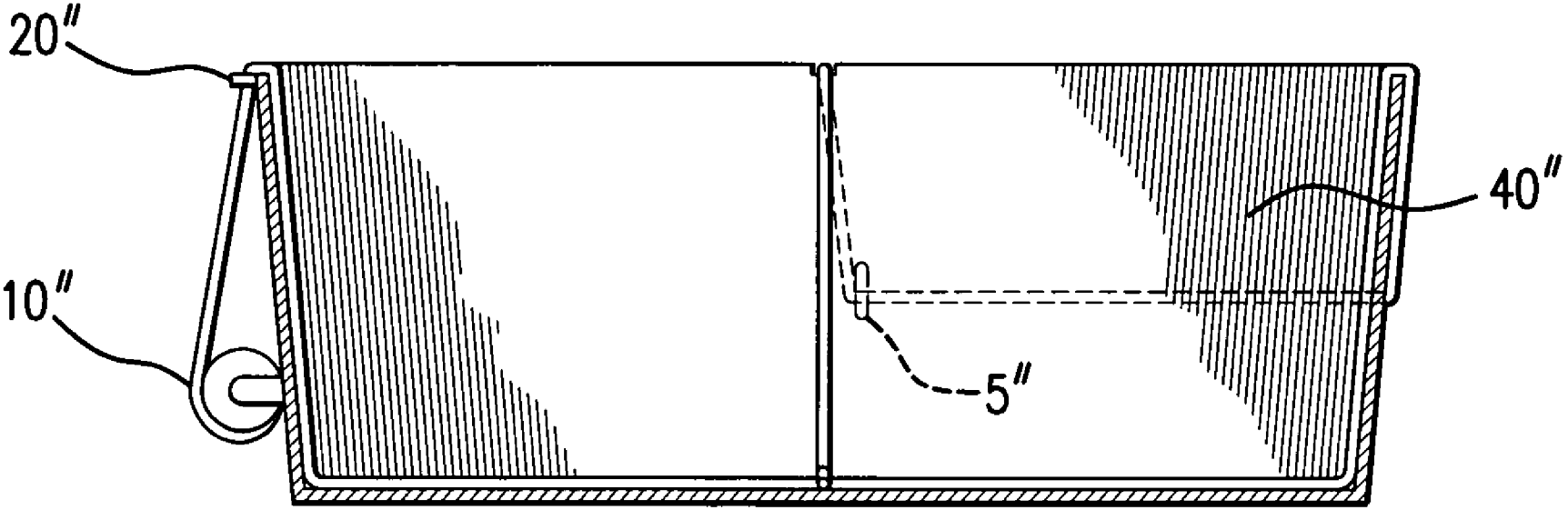
FIG. 2 is an illustration of a side view of the invention device.

FIG. 2 illustrates a side view of the invention device, showing the placement of the cutting blade 20" and the twine 10" as well as the third notch 5" and storage unit 40" and the pre-arrangement of the twine within the storage unit.

Figure 3B:
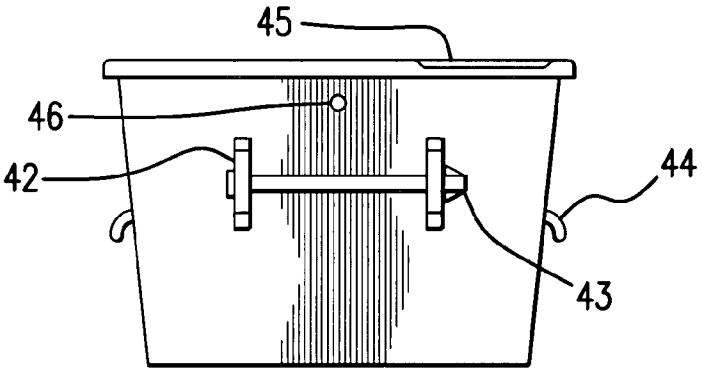
FIGS. 3A, 3B and 3C are illustrations of a preferred embodiment of the invention showing the side view with the hook, the side view with the spool and the top view, respectively.
Figure 3A:
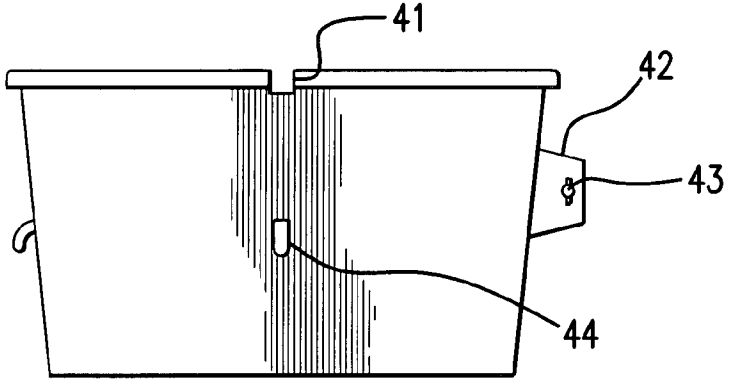
Figure 3C:
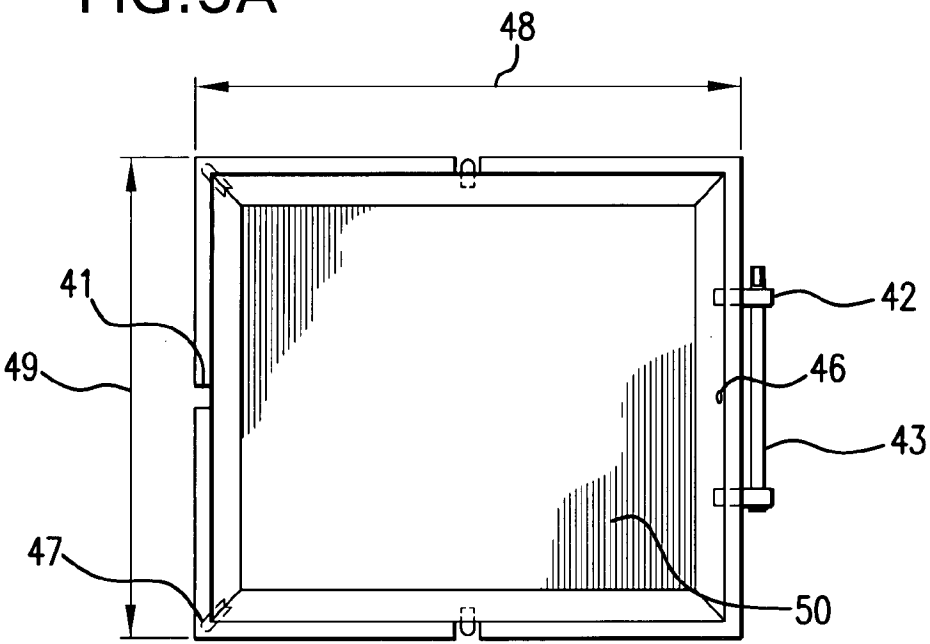

FIGS. 3A, 3B and 3C illustrate illustrations of a preferred embodiment of the invention showing the side view of the device with the hook, the side view of the device with the spool and the top view of the device, respectively.

In FIG. 3A the top notch 41 is preferably ¾"×¾" in the lip of the device, although the top notch can be just a slot wide enough to fit and secure the twine or up to 1" or so wide. The top dimension length is preferably 1'6" and the height is 10". As mentioned earlier the minimum height of the device is preferably 6" and up. The bottom dimension length of the device is preferably 1' 4¼". A hook 44 is positioned on side A-A1. The rod support 42 holds a ⅜" plastic rod with spring loaded locking mechanism 43 for easy replacement, removal and securing of the twine spool.

In FIG. 3B side B-B1 is shown which shows the rod support 42 and plastic rod with spring loaded locking mechanism 43 for placement of the twine spool.

FIG. 3C shows a top view of the device illustrating the storage space 50 within the storage unit itself. The waste papers, newspapers, magazines or other materials are placed in this space until full or ready to be bundled and disposed of. The lip of the device on side A-A1 48 preferably measures 1'7" long and the lip on side B-B1 49 preferably measures 1'4" long. Hook 47 is shown in the corner of the device. Although preferred dimensions are described in FIGS. 3A, 3B and 3C they are for illustrative purposes only and other dimensions and sizes can be constructed including all the structural elements of the invention device.

The foregoing description of various and preferred embodiments of the present invention has been provided for purposes of illustration only, and it is understood that numerous modifications, variations and alterations may be made without departing from the scope and spirit of the invention as set forth in the following claims.

What is claimed is:

1. A device for storing and bundling papers, magazines and/or cardboard, for easy disposal and recycling, the device comprising:

a rectangular or square shaped storage unit consisting essentially of four side walls and a bottom surface wherein a top area is open and permits stacking of papers on said bottom surface;

a single source of twine located on a spool attached to the outer surface of one of said side walls;

a cutting blade situated on the ton lip, of the side wall containing said twine; and at least six means for holding said twine in place such that said twine is in a pre-arranged pattern within said storage unit and is held in place by said means for easy bundling of the papers, magazines and/or cardboard, wherein the first means of said at least six means for holding said twine in place is a hole on the side wall containing the spool of twine, the second means of said at least six means for holding said twine in place is a first notch on the top lip of the side wall opposite the spool of twine, the third means of said at least six means for holding said twine in place is a first hook on the corner edge of the side wall opposite the spool of twine, the fourth means of said at least six means for holding said twine in place is a second notch on side wall next to side wall containing the spool of twine, the fifth means of said at least six means for holding said twine in place is a third notch on the side wall opposite to the side wall having the second notch, and the sixth means of said at least six means for holding said twine in place is a second hook located underneath third notch and on the sidewall of the third notch.

2. A device according to claim 1, wherein said side wall opposite the side wall containing said twine has a slot on the top lip such that the twine can be placed in said slot without slipping.

3. A device according to claim 1, further comprising a handle on at least one side wall.

4. A device according to claim 1, wherein said storage unit is made of plastic.

5. A method for bundling papers, magazines and/or newspapers for easy disposal and recycling comprising the steps of:

providing a device for storing and bundling waste papers, magazines and/or newspapers for disposal, wherein said device is comprised of a storage unit having four side walls and a bottom surface, and a top area which is open and permits stacking of the waste papers, magazines and/or newspapers; a single source of twine located on a spool attached to the outer surface of one of said side walls; a cutting blade situated on the top lip of the side wall containing said twine; and at least six means for holding said twine in place such that said twine is in a pre-arranged pattern within said storage unit, wherein said twine is looped through the first means which is a hole 1 on the side wall containing the spool of twine;

pulling said twine across said bottom surface of said storage space to rest on the second means which is a first notch 2 on the top lip of the side wall opposite the spool of twine;

wrapping said twine around the third means which is a first hook 3 on the corner edge of the side wall opposite the spool of twine;

placing said twine on the fourth means which is a second notch 4 on side wall next to side wall containing the spool of twine;

pulling said twine across said bottom surface of said storage space to rest on the fifth means which is a third notch 5 on the opposite side wall, wherein the twine is formed into a cross shape in the center of the storage space;

looping said twine to the sixth means which is a second hook 6 located on the side wall underneath third notch 5;

placing waste paper in the center of the storage space;

cutting said twine closest to said spool emerging from said hole 1 using the blade located on the side wall containing the spool of twine;

removing said twine from first hook 3 and bringing twine from second and third notches 4 and 5 to the center of said storage space;

tying said twine ends from the first means and the sixth means on top of said waste paper bundle; and removing the tied bundle from said storage unit for recycling.

6. A method for bundling papers, magazines and/or newspapers for easy disposal and recycling comprising the steps of:

providing a device for storing and bundling waste papers, magazines and/or newspapers for disposal, wherein said device is comprised of a storage unit having four side walls and a bottom surface, and a top area which is open and permits stacking of the waste papers;

a single source of twine located on a spool attached to the outer surface of one of said side walls; a cutting blade situated on the top lip of the side wall containing said twine; and at least five means for holding said twine in place such that said twine is in a pre-arranged pattern within said storage unit, wherein said twine is looped through a hole 1 on the side wall containing the spool of twine;

pulling said twine across said bottom surface of said storage space to rest on a first means for holding or securing the twine on the top lip of the side wall opposite the spool of twine;

wrapping said twine around a second means for holding or securing the twine on the corner edge of the side wall opposite the spool of twine;

placing said twine on a third means for holding or securing the twine on side wall next to side wall containing the spool of twine;

pulling said twine across said bottom surface of said storage space to rest on a fourth means for holding or securing the twine on the opposite side wall, wherein the twine is formed into a cross shape in the center of the storage space;

looping said twine to a fifth means for holding or securing the twine located on the side wall underneath said fourth means;

placing waste paper in the center of the storage space;

cutting said twine closest to said spool emerging from said hole 1 using the blade located on the side wall containing the spool of twine;

removing said twine from said second means and unlooping said twine from said fifth means and bringing twine from said third and fourth means to the center of said storage space;

looping the open twine end from the fifth means under the twine from said third and fourth means on top of said waste paper bundle;

tying said cut twine end with said end from the fifth means; and removing the bundle from said storage unit for recycling.

7. The method according to claim 6, wherein the means for holding or securing the twine in place is selected from the group consisting of hooks, notches, latches, slots, holes or other like means and combinations thereof.

* * * * *